United States Patent [19]

Mallet et al.

[11] Patent Number: 4,836,808

[45] Date of Patent: Jun. 6, 1989

[54] CAPTIVE NUT TERMINAL FOR ELECTRONIC MODULE POWER CONNECTORS

[75] Inventors: Jean-Louis Mallet; Jean-Louis Landais, both of Merignac, France

[73] Assignee: Power Compact, Societe Anonyme, Merignac, France

[21] Appl. No.: 184,954

[22] Filed: Apr. 22, 1988

[30] Foreign Application Priority Data

Apr. 22, 1987 [FR] France ..... 87 05877

[51] Int. Cl.[4] ..... H01R 4/38

[52] U.S. Cl. ..... 439/813; 439/736

[58] Field of Search ..... 439/604, 606, 722, 736, 439/737, 801, 813

[56] References Cited

U.S. PATENT DOCUMENTS

| | | | |
|---|---|---|---|
| 1,517,017 | 11/1924 | Roth | 439/722 X |
| 1,536,024 | 4/1925 | Kvaal | 439/801 |
| 2,849,699 | 8/1958 | Demurjian | 439/722 |
| 4,040,715 | 8/1977 | Debaigt | 439/813 |
| 4,219,251 | 8/1980 | Romine . | |

FOREIGN PATENT DOCUMENTS

| | | | |
|---|---|---|---|
| 629550 | 7/1963 | Belgium | 439/801 |
| 1094333 | 12/1960 | Fed. Rep. of Germany . | |
| 2039691 | 8/1980 | United Kingdom . | |

*Primary Examiner*—Eugene F. Desmond

*Attorney, Agent, or Firm*—Foley & Lardner, Schwartz, Jeffery Schwaab, Mack, Blumenthal & Evans

[57] ABSTRACT

The invention relates to a captive nut terminal for an electronic module power connector (4,4'), of the type comprising a lug (**4*b*) projecting above the resin embedding the circuits of the module, bent at right angles above the upper face of the module and having a hole (6) for the subsequent passage of a screw for connection to an external terminal and a nut disposed under said lug in line with the hole, said terminal being characterized in that the nut is held captive in a housing (8) of a size and shape allowing the nut a slight multidirectional play but preventing rotation thereof, said housing being formed in the upper face of a piece (7,7') fixed to and positioned on the connector (4,4'), under the lug (4*b*), and having, on at least one of its sides, a hollow (13**) for anchoring said piece in said resin.

5 Claims, 2 Drawing Sheets

CAPTIVE NUT TERMINAL FOR ELECTRONIC MODULE POWER CONNECTORS

The present invention relates to electronic modules, particularly power modules and relates more precisely to the screw and nut connection systems with which the power connectors of such modules are usually provided.

This type of connector is often connected to the electronic power circuits for which the module is intended, by a screw and nut system, the screw being engaged in a hole formed in the end of the power connector projecting above the module and bent at right angles parallel to the surface of said module.

Such a connection system requires correct positioning of the nut under the bent end of the connector, so that the power connectors and the external terminals can be connected together as perfectly as possible.

The nuts are positioned during manufacture of the module under the bent lugs of the power connectors and are imprisoned by the resin surrounding the circuits of the module.

If often happens that the position of the nut is not correct, either because the axis of the nut is slanted with respect to that of the hole facing the bent lug, or because the nut is slightly offset with respect to the hole, or both. This of course raises problems at the time of engaging the screw for assembling the terminals to be joined together, since the pieces risk being poorly clamped, even having a slight clearance therebetween because of the impossibility of screwing the screw home.

In another known procedure the straight connectors without bent lugs are welded, a molded plastic cover is inserted and then the lugs are bent over the cover. This latter has at appropriate positions a hexagonal imprint of the captive nut.

The drawback of this method is the absence of flexibility in positioning the electric terminals with respect to the circuits of the module, the position of these terminals being determined by the choice of mold, of the cover as well as by the machines and tools used for bending the connectors.

The aim of the invention is to overcome these drawbacks by proposing in the construction of this type of module a system for positioning the nuts opposite holes in the bent lugs of the power connectors, reliably ensuring the correct positioning of the nut in the axis of the hole at the time of screwing up the connecting screw and allowing the electric terminal to be readily positioned in various positions on the circuits through a connector and captive nut terminal interlock and easy positioning through a guide piece. For this, the invention provides a captive nut terminal for electronic module power connectors, of the type comprising a lug projecting above the resin embedding the circuits of the module, bent at right angles above the upper face of the module and having a hole for subsequently passing therethrough a screw for connection to an external terminal and a nut disposed under the lug in line with the hole, said terminal being characterized in that the nut is held captive in a housing of a size and shape allowing a slight multidirectional play for the nut but preventing rotation thereof, said housing being formed in the upper face of a piece fixed to and positioned on the connector, under the lug, and having on at least one of its sides, a hollow for anchoring said piece in said resin.

In a first embodiment, said piece is in the form of a die having on its upper face a hexagonal housing whose dimensions are slightly greater than those of the nut to be received, pierced in its central part with a well for receiving the end of the connecting screw, whereas the lateral face turned towards the vertical portion of the power connector is provided with means for snap-fitting the dice on said connector. If required, the portion of the connector receiving the die shaped snap-fitting piece is pierced with a hole for inserting a drop of glue, thus providing effective durable fixing between the piece and the connector, so that they can be handled without previous precautions and thus facilitating correspondingly the manufacture, the positioning and the welding of the connector to the power circuits of the module.

According to another characteristic of the device of the invention, the die is provided on its other three lateral faces with a horizontal groove anchoring said piece in the resin.

Other features and advantages will be clear from the following description of one embodiment of the device of the invention, which description is given by way of example with reference to the accompanying drawings in which.

Figure 1:
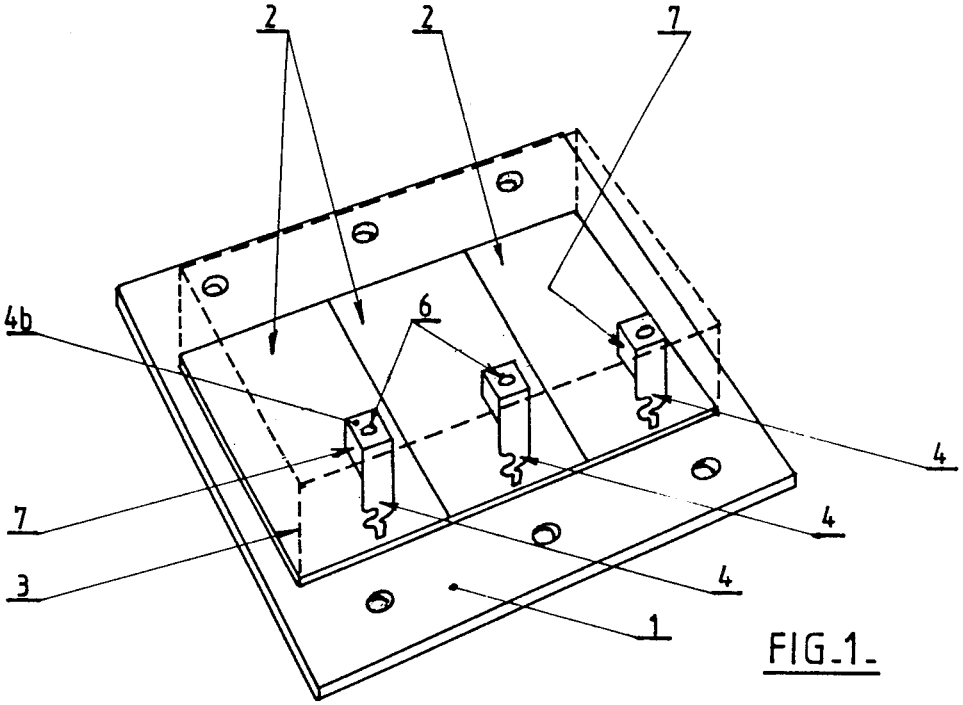
FIG. 1 is a perspective view of a module having power connectors equipped with captive nut terminals in accordance with the invention.

In FIG. 1, three ceramic wafers 2 have been shown, fixed to a heat dissipating base 1, and carrying power circuits of an electronic module.

These circuits will subsequently, at the end of manufacture of the module, be surrounded by a wall symbolized at 3 which will be filled with an appropriate resin so that the ends of the power connectors 4 of the circuits of wafers 2 project from the surface of the module.

In the embodiment shown, connectors 4 are formed by a flat conductor whose lower end **4*a*** is of reduced and sinuous section so as to accommodate possible expansion following temperature rises generated by the power circuits in particular.

Figure 2:
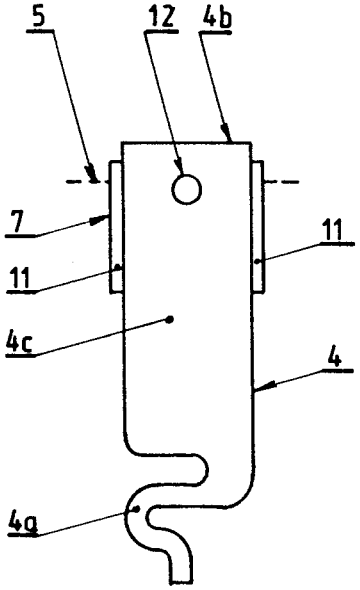
FIG. 2 is an enlarged elevational view of a power connector in accordance with FIG. 1.
Figure 3:
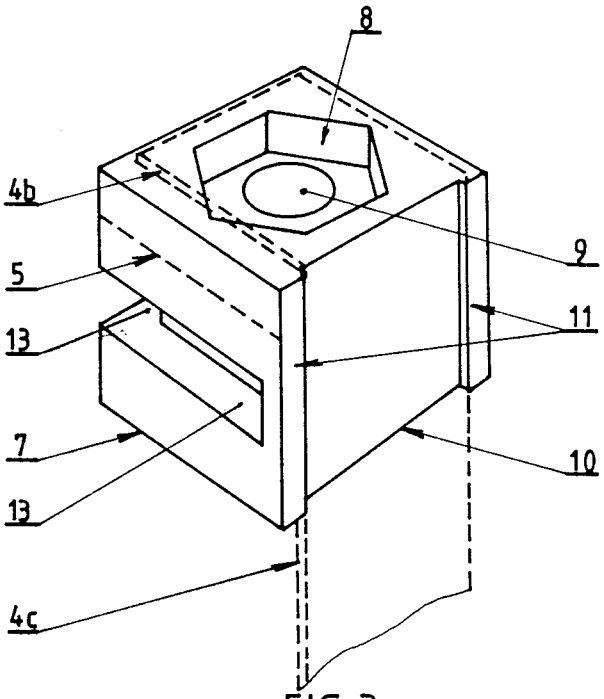
FIG. 3 is a perspective view of the piece in the form of a dice retaining the captive nut.

The upper end of connectors 4 is in the form of a lug **4*b* bent at right angles slightly above the resin layer whose upper face has been symbolized at 5 in FIGS. 2 and 3**.

Between the horizontal lug **4*b* and the lower end 4*a* welded to the circuits of wafers 2, connector 4 has a flat vertical portion 4*c*** parallel to the wall.

In FIG. 1, for the sake of clarity, only three connectors 4 have been shown disposed adjacent one of the sides of wall 3, three other connectors (not shown) being disposed opposite the three which are visible.

The horizontal lugs of the connectors are pierced with holes 6 for subsequent engagement of the screw for connection to the external terminals.

These screws are intended to cooperate with nuts held captive under each lug **4*b* in a piece 7** in the form of a die in the embodiment shown.

The dice 7 are for example made from a molded plastic material and have on the upper face turned towards lugs 4*b* a hexagonal imprint 8 whose dimensions are slightly greater than those of the nut which is to be received therein, so as to allow this latter a slight play practically in all directions while preventing it from rotating with the screw. The centre of imprint 8 is pierced with a blind hole or well 9 for receiving the end of the screw.

In order to fix the die to connect 4, the side face of the die turned upwardly of portion 4*c* of the connector is snap-fitted on portion 4*c* through a wide groove 10 formed in said lateral face of the die, over the whole of its height. Groove 10 however does not occupy the whole width of the face of the die so as to provide two parallel projecting ribs 11 separated by a distance equal to the width of connector 4*c*.

The material forming the die has a certain elasticity facilitating engagement of the die on the connector 4*c*, as illustrated in FIG. 3, the imprint 8 with its nut (not shown) being located under lug 4*b*, at a very small distance therefrom and practically in the axis of hole 6, whereas the two ribs 1 resiliently grip the portion 4*c* of the connector and apply it against die 7.

To make the fixing perfect, a hole 12 may be formed in portion 4*c* of the connector, in line with the die 7 (FIG. 2) so as to place therein a drop of glue thus binding the die to the connector. The assembly may be of the sort which can be handled without any risk of separation of the elements.

As shown in FIG. 3, the other three vertical side faces of die 7 are provided with recesses or horizontal grooves 13.

In the faces adjacent the snap-fit face of the die, grooves 13 preferably end at a distance from ribs 11 so as not to disturb snap-fitting, whereas on the face opposite this latter groove 13 runs over the whole width of the die.

Grooves 13 play a role of anchoring the die in the resin of the module whose upper level 5 is slightly below the upper face of the die.

The connectors 4 are positioned in the following way. All the connectors are held vertically in position in line with the welding zones on wafers 2 by means of a horizontal guide plate (not shown) in which rectangular windows are formed in which the connector 4-dice 7 assemblies, which are thus fixed laterally, are inserted with a slight play.

Figure 4:
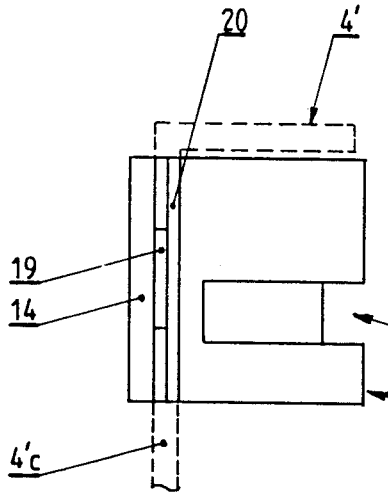
FIG. 4 is a side elevational view of a variant of embodiment of a dice of the type shown in FIG. 3.
Figure 5:
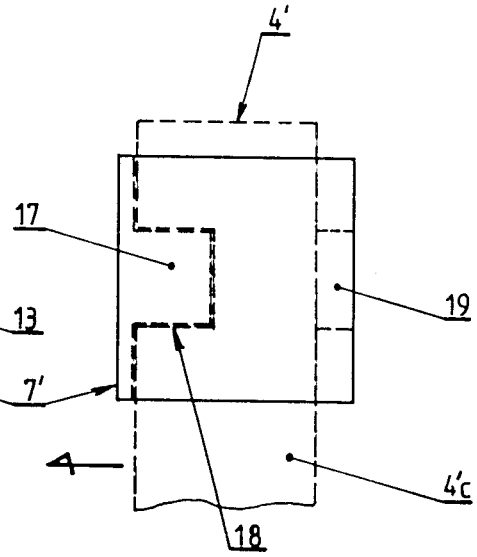
FIG. 5 is a left-hand view of the device of FIG. 4.
Figure 6:
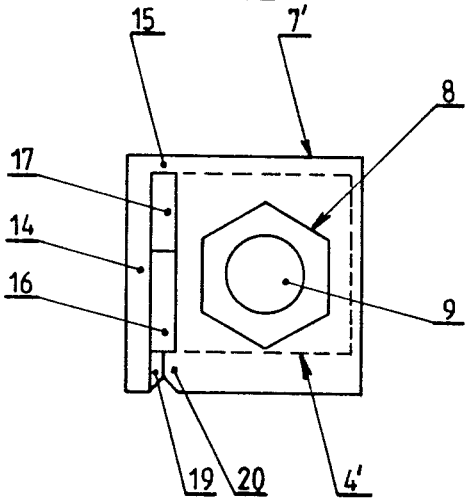
FIG. 6 is a top view of the device of FIG. 4.

FIGS. 4 to 6 illustrate a variant of construction of the means for fixing the die to the connector.

In this variant die 7′, in all other respects identical to die 7 of FIG. 3, is provided on its face turned towards the vertical portion 4′*c* of connector 4′ with a tongue 14 convering the whole of the face of the die turned towards the connector.

This tongue 14, of small thickness, is attached to die 7′ by a bridge 15 in the vicinity of one of the edges of the die and defines between it and the face of the die a passage 16 for the passage of portion 4′*c* having a rectangular section corresponding to that of said portion 4′*c*.

In passage 16 is formed transversely a projection 17 for locking portion 4′*c* in position which is provided for this purpose with a corresponding recess 18 (FIG. 5).

On the side of passage 16 opposite bridge 15, tongue 14 is provided on the inside with a hook shaped flange 19 cooperating with a projection 20 formed opposite on the face of die 7′ turned towards portion 4′*c*.

Because of the elasticity of tongue 14, the portion 4′*c* of connector 4′ is engaged laterally in passage 16 of the die in the direction of the arrow of FIG. 5. Projections 19 and 20 move away from each other and when the connector is completely engaged in passage 16, as illustrated with broken lines in FIGS. 4 to 6, it is locked in position in both directions by said projections 19, 20 and projection 17.

Of course, the invention is obviously not limited to the embodiments shown and described above but covers on the contrary all variations thereof particularly in so far as the shape and dimensions of piece 7, 7′ are concerned, the nature of the means for fixing piece 7,7′ to connector 4, 4′, the shapes and dimensions of the housing 8 for receiving the nut as well as the auxiliary means (13) for anchoring piece 7, 7′ in the resin and possible positioning of the connector 4, 4′-piece 7, 7′ assembly on said guide plate.

We claim:

1. Captive nut terminal for an electronic module power connector which connects external terminals to a resin embedded circuit module comprising a lug projecting above the resin embedding the circuits of the module, bent at right angles above the upper face of the module and having a hole for the subsequent passage of a screw for connection to an external terminal and a nut disposed under said lug in line with the hole, said terminal being characterized in that the nut is held captive in a housing of a size and shape allowing the nut a slight multidirectional play but preventing rotation thereof, said housing being formed in the upper face of a piece fixed to and positioned on the connector, under the lug, and having, on at least one of its sides, a hollow for anchoring said piece in said resin.

2. Terminal according to claim 1, characterized in that said piece is in the form of a die having on its upper face a hexagonal housing with dimensions slightly greater than those of the nut to be received, pierced in its central part with a well for receiving the end of the connection screw, whereas the side face turned towards the vertical portion of the power connector is provided with means for snap-fitting the die on said connector.

3. Terminal according to claim 2, characterized in that said snap-fit means are formed by a recess in which the upper part of the connector is received, the two projecting edges of said recess facing each other and resiliently imprisoning the opposite edges of said portion of the connector.

4. Terminal according to claim 2, characterized in that said snap-fit means are formed of a tongue formed in the face of the die turned towards the upper portion of the connector and able to receive said portion, held imprisoned by appropriate projections or hooks.

5. Terminal according to claim 2, wherein said piece in the form of a die further comprises a recessed portion for anchoring the piece in the resin embedding the circuits of the module.

* * * * *